US008770635B2

(12) United States Patent
Schwickerath et al.

(10) Patent No.: US 8,770,635 B2
(45) Date of Patent: Jul. 8, 2014

(54) GRAPPLE STYLE COMPRESSION LATCH

(75) Inventors: Tobias J. Schwickerath, New Hampton, IA (US); Christopher M. Lane, New Hampton, IA (US); Ricci L. Marzolf, New Hampton, IA (US); Bruce E. Kallevig, Monticello, MN (US)

(73) Assignee: Trimark Corporation, New Hampton, IA (US)

( * ) Notice: Subject to any disclaimer, the term of this patent is extended or adjusted under 35 U.S.C. 154(b) by 401 days.

(21) Appl. No.: 13/090,765

(22) Filed: Apr. 20, 2011

(65) Prior Publication Data

US 2012/0267904 A1 Oct. 25, 2012

(51) Int. Cl.

| | |
|---|---|
| ***E05C 3/04*** | (2006.01) |
| ***E05B 65/12*** | (2006.01) |
| ***F41H 5/22*** | (2006.01) |
| ***E05B 5/00*** | (2006.01) |
| ***E05B 13/00*** | (2006.01) |
| *E05C 3/14* | (2006.01) |
| *E05B 67/38* | (2006.01) |

(52) U.S. Cl.

CPC ..... *E05B 13/002* (2013.01); *E05B 85/245* (2013.01); *F41H 5/226* (2013.01); *E05B 67/383* (2013.01); *E05B 5/006* (2013.01); *E05C 3/042* (2013.01); *E05B 85/14* (2013.01); *E05B 83/01* (2013.01); *Y10S 292/31* (2013.01)

USPC ..... 292/218; 292/116; 292/118; 292/194; 292/DIG. 31

(58) Field of Classification Search

USPC ..... 292/95, 116–118, 120, 121, 126, 194, 292/195, 200, DIG. 31, 218

See application file for complete search history.

(56) References Cited

U.S. PATENT DOCUMENTS

| | | | | | |
|---|---|---|---|---|---|
| 3,857,594 | A | * | 12/1974 | Pastva, Jr. | 292/27 |
| 3,858,916 | A | * | 1/1975 | Torii et al. | 292/45 |
| 3,970,213 | A | | 7/1976 | Clay | |
| H358 | H | * | 11/1987 | Kaveney, Jr. | 292/216 |
| 4,911,487 | A | * | 3/1990 | Rachocki | 292/216 |
| 5,171,048 | A | * | 12/1992 | Weinerman et al. | 292/45 |
| 5,192,096 | A | * | 3/1993 | Weinerman et al. | 292/45 |
| 5,209,530 | A | * | 5/1993 | Kolloch | 292/27 |
| 5,267,762 | A | | 12/1993 | Gromotka | |
| 5,526,660 | A | * | 6/1996 | Bennett et al. | 70/208 |
| 5,609,373 | A | | 3/1997 | Gromotka | |
| 5,984,383 | A | * | 11/1999 | Parikh et al. | 292/121 |
| 5,992,908 | A | | 11/1999 | Yared et al. | |
| 6,158,787 | A | * | 12/2000 | Kutschat | 292/214 |
| 6,418,761 | B1 | | 7/2002 | Wytcherley et al. | |

(Continued)

OTHER PUBLICATIONS

Southco, Southco Pawl/Cam Action Latches, (Flush T-handle Series, Heavy Duty Style), Southco Pamphlet.

(Continued)

*Primary Examiner* — Carlos Lugo

(74) *Attorney, Agent, or Firm* — McKee, Voorhees & Sease, P.L.C.

(57) ABSTRACT

A grapple style compression latch is provided for a vehicle door. The latch includes a pair of opposing jaws to retain and release a striker on the door frame. The movement of the grapple jaws is controlled by a handle mounted on the latch housing and moveable between open and closed positions. Drive links and a plurality of jaw pins control the movement of the jaws between open and closed positions. A compression spring provides over-center action for the latch.

18 Claims, 11 Drawing Sheets

(56) References Cited

U.S. PATENT DOCUMENTS

| | | | | |
|---|---|---|---|---|
| 6,419,284 | B1 * | 7/2002 | Kutschat | 292/56 |
| 6,953,209 | B2 * | 10/2005 | Jackson et al. | 292/66 |
| 7,097,216 | B2 * | 8/2006 | Lane et al. | 292/216 |
| 7,267,377 | B2 * | 9/2007 | Marzolf et al. | 292/25 |
| 7,309,087 | B2 * | 12/2007 | Lane et al. | 292/216 |
| 7,338,097 | B2 * | 3/2008 | Marzolf et al. | 292/216 |
| 7,398,664 | B1 * | 7/2008 | Weinerman et al. | 70/208 |
| 7,454,933 | B1 * | 11/2008 | Paige et al. | 70/208 |
| 7,726,707 | B2 * | 6/2010 | Simchayoff et al. | 292/216 |
| 7,748,246 | B1 | 7/2010 | Paige et al. | |
| 8,016,329 | B2 | 9/2011 | Johansson et al. | |
| 8,276,950 | B2 * | 10/2012 | Kutschat | 292/216 |
| 8,439,409 | B2 * | 5/2013 | Uto et al. | 292/340 |

OTHER PUBLICATIONS

Southco, Southco Pawl/Cam Action Latches (Flush T-handle Series, Fixed-grip Style), Southco Pamphlet.

* cited by examiner

GRAPPLE STYLE COMPRESSION LATCH

FIELD OF THE INVENTION

A grapple style compression latch is provided for use on off-highway vehicles and equipment, on-highway vehicles, stationary equipment, and other applications to retain a compartment door or access panel door in a closed position under heavy or high vibration loads.

BACKGROUND OF THE INVENTION

Compartment and access panel doors on vehicles and other equipment normally include a latch to retain the door in a closed position. There are many different types of latches, depending on the particular use or application. For example, there are rotor-style latches, slam action latches, compression latches, as well as others. The environment where the vehicle or equipment is used often dictates the best type of latch for the compartment door. For example, vehicles and equipment used off road are often subjected to heavy loads and excessive vibrations or shocks, which may result in accidental opening of the door and premature failure due to excessive wear. Other types of compartments require compression seals, such as for sound mitigation. Also, pressure seals are often used on compartment doors, such as on RV's, marine applications, and military vehicles with explosion-proof compartments.

Therefore, a primary objective of the present invention is the provision of an improved door latch for use in applications having heavy vibration or shock loads.

Another objective of the present invention is the provision of a grapple style door latch with opposing jaws to capture a pin style striker on a vehicle or equipment door frame.

Another objective of the present invention is the provision of a grapple latch which eliminates or minimizes accidental opening of a compartment door.

Still another objective of the present invention is the provision of a grapple compression latch which captivates the striker in three axes.

Another objective of the present invention is the provision of a compression grapple latch which captures the striker to restrict vibration loading.

A further objective of the present invention is the provision of a grapple latch having an intuitive operation.

Yet another objective of the present invention is the provision of a grapple style compression latch for a vehicle or compartment door which is actuated without turning the door handle.

Another objective of the present invention is the provision of a grapple style latch for use with folding exterior door handle having a low profile.

A further objective of the present invention is the provision of a grapple style compression latch having a long useful life under extreme use conditions.

Yet another objective of the present invention is the provision of a grapple style latch which is more robust and secure than other types of latches.

Still another objective of the present invention is the provision of a grapple style latch which is durable and safe in use, and easy to operate.

These and other objectives have become apparent from the following description of the invention.

SUMMARY OF THE INVENTION

The grapple style compression latch of the present invention includes a housing having opposite front and rear, or exterior and interior sides. A handle is pivotally mounted on the exterior side to operate opposing grapple jaws on the interior side of the housing. The jaws move between open and closed positions to capture and release a pin style striker on a vehicle door frame. The jaws are mounted on a bracket on the inside of the housing and are connected to the handle by a pair of drive links. The jaws include cam slots which interface with jaw pins which drive the jaws between the open and closed positions for engaging and disengaging the striker. A compression spring on the interior side of the housing provides a load or force for an over-center action of the handle. The opposing grapple jaws provide a secure retention of the striker pin, even in situations of severe vibration and/or high loads, such as those that arise in off-road vehicle usage. The housing also includes a secondary spring clip to temporarily retain the door in a partially closed position so as to minimize door bounce back after the door is pushed or slammed toward the closed or shut position, until the handle is fully depressed to the closed or latched position to fully latch the striker.

DETAILED DESCRIPTION OF THE DRAWINGS

Figure 1:
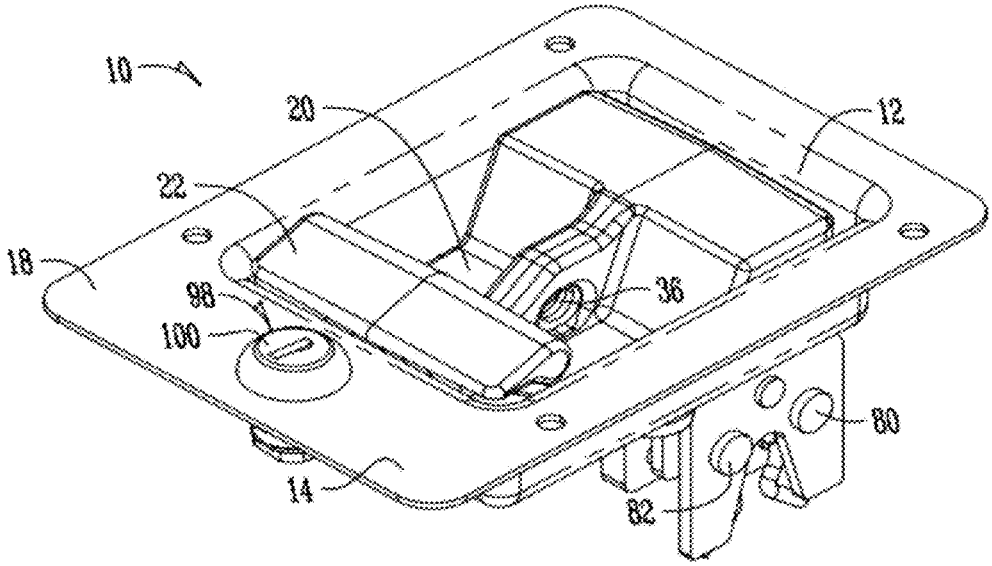
FIG. 1 is a perspective view of the assembled grapple style compression latch of the present invention, from a front or exterior angle, with a key lock mechanism.
Figure 2:
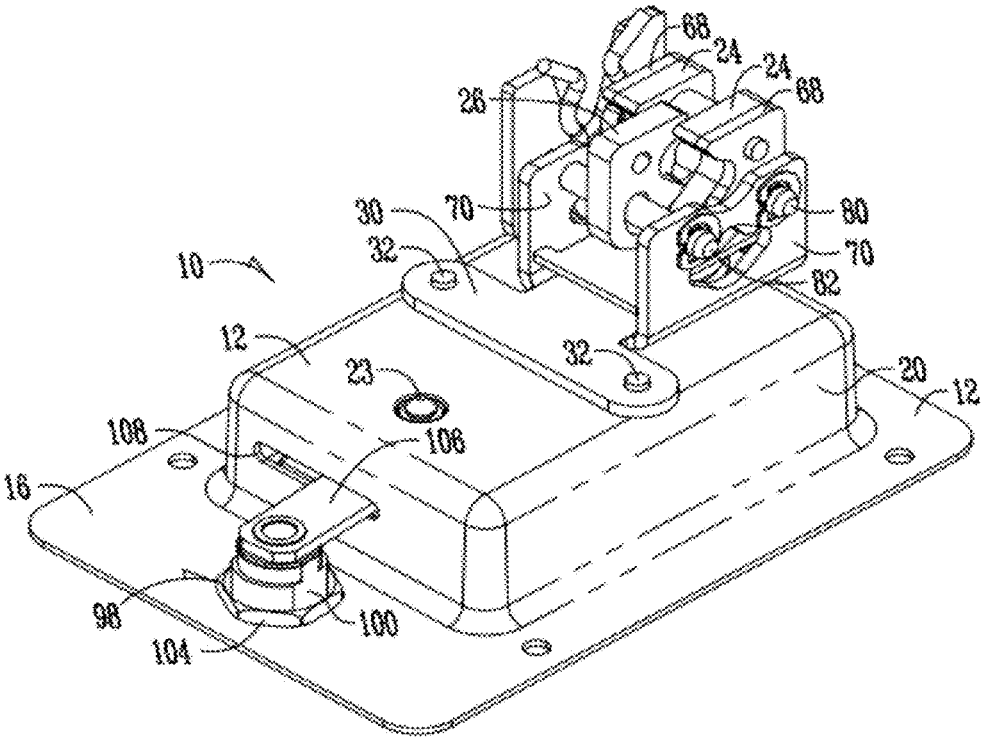
FIG. 2 is a perspective view of the latch from a rear or interior angle, with a key lock mechanism.

The grapple style compression latch of the present invention is generally designation in the drawings by the reference numeral 10. The latch 10 is intended for use on vehicle doors, and particularly, vehicles which are subjected to severe vibrations and high loads, such as off-road vehicles.

The latch 10 includes a housing 12 having a front or exterior side 14 and a rear or interior side 16. The housing 12 includes an outer perimeter flange 18 surrounding a wall or recess 20. Preferably, the housing 12 is formed from one piece of stamped sheet metal.

A handle 22 is pivotally mounted and aligned in the well 20 on the front 14 of the housing 12. A pair of opposing jaws 24, 26, are pivotally mounted on the back side of the well 20 on the rear 16 of the housing 12. The handle 22 is pivotal between a closed position (shown in FIGS. 5-10) and an open position (shown in FIGS. 11-16). A pad or bumper 23 is mounted in a hole 25 in the well 20 beneath the handle 22 to provide sound and vibration dampering when the handle 22 is moved to the closed position. The jaws 24, 26, are also movable between a latched or closed position (shown in FIGS. 6-10) and an unlatched or open position (shown in FIGS. 12-16). The movement of the handle 22 controls the movement of the jaws 24, 26.

An outside bracket 28 and an inside bracket 30 are fixed to the outside and inside of the well 20 on the front 14 and rear 16 of the housing 12, respectively, with fasteners, such as rivets 32. The outside bracket 28 includes an upstanding ear 34 with a hole 35 which aligns with a hole 36 in the handle 22 for receiving a padlock (not shown), so as to lock the handle 22 in the closed position, if desired, for additional security.

A pair of links 38 extend through aligned slots 40, 42, 44, and 46 in the outside bracket 28, the housing well 20, the inside bracket 30, and an inside plate 48, respectively. The outer ends of the links 38 have holes 50, while the inner ends of the links 38 have holes 52. The outer ends of the links 38 reside between opposing legs of a u-shaped yoke 54, which in turn resides between spaced apart legs 62 on the outside bracket 28, which in turn reside between opposite side legs 56 of the handle 22. A pin 58 extends through aligned holes in the handle legs 56 and yoke legs 54 and through the outer holes 50 of the links 38 so as to interconnect the links 38, the yoke 54, and the handle 22. The pin 58 is also cradled in notches 60 formed in the upstanding legs 62 of the outside bracket 28, so as to center the handle and maintain alignment of the handle 22 in the well of the housing 12. The pin 58 does not extend through the walls of the well 20 of the housing 12.

A drive pin 64 extends through the holes 52 on the inner ends of the links 38. The jaws 24 and 26 are also pivotally mounted on the pin 64, which extends through holes 65 on the jaws 24 and a hole 67 on the jaw 26. The jaw 26 resides between the links 38. The links 38 reside between the jaws 24, which in turn reside between a pair of spaced apart upstanding legs 70 on the bracket 30.

A pair of spacers 68 are mounted on opposite sides of the jaws 24 by a second pin 72. A third pin 80 extends through aligned holes in the legs 70 and through aligned slots 74 in the jaws 24 and slots 76 in the spacers 68. A fourth pin 82 extends through a slot 86 in the third jaw 26. The pins 80, 82 are retained by clips 78.

A compression spring 88 is mounted between the inside bracket 30 and the plate 48. When the handle 22 is in the closed position, the spring 88 is compressed between the inside bracket 30 and the plate 48. When the handle 22 is moved to the open position, spring 88 forces the plate 48 and the links 38 rearwardly, which in turn pushes the lower ends of the jaws 24, 26 inwardly or rearwardly by the interconnecting pin 64. The movements of the links 38 cause the jaws 24, 26 to open due to the arrangement of the slots 74, 86 on the fixed guide pins 80, 82. The spring 88 provides over-center action to the handle 22 in both the open and closed positions. When the handle 22 is in the open position, this over-center function of the spring notifies an operator that the door is not latched and fully secured. The over-centering function of the handle 22 is achieved due to the geometry of legs of the yoke 54. The pin 58 interacting with the notches 60 also keeps the handle 22 centered, and assures proper over-centering of the handle 22.

Figure 10:
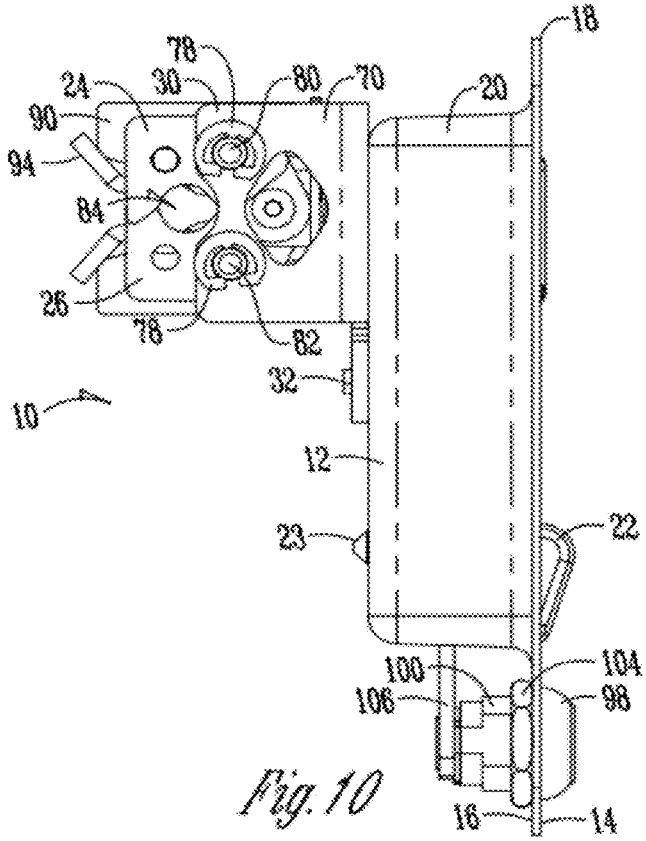
Figure 11:
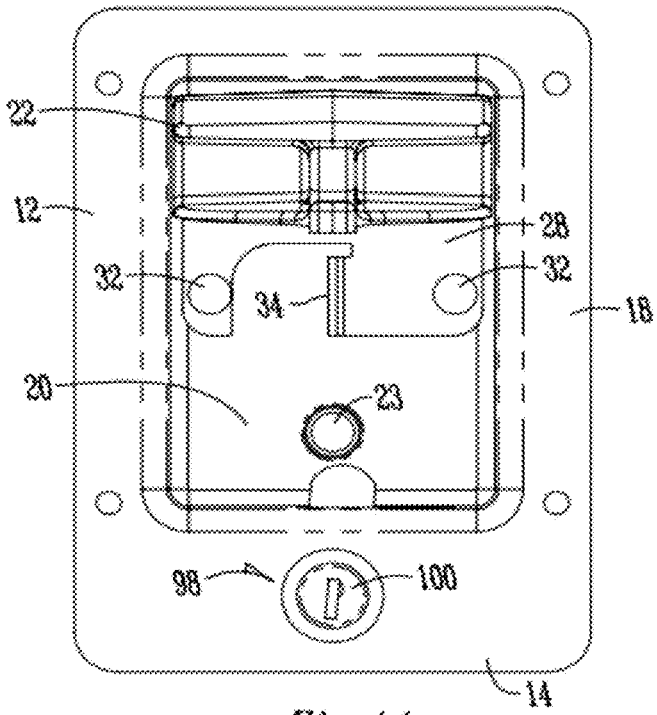
FIG. 11 is a front plan view of the latch, with the handle in the open position.
Figure 12:
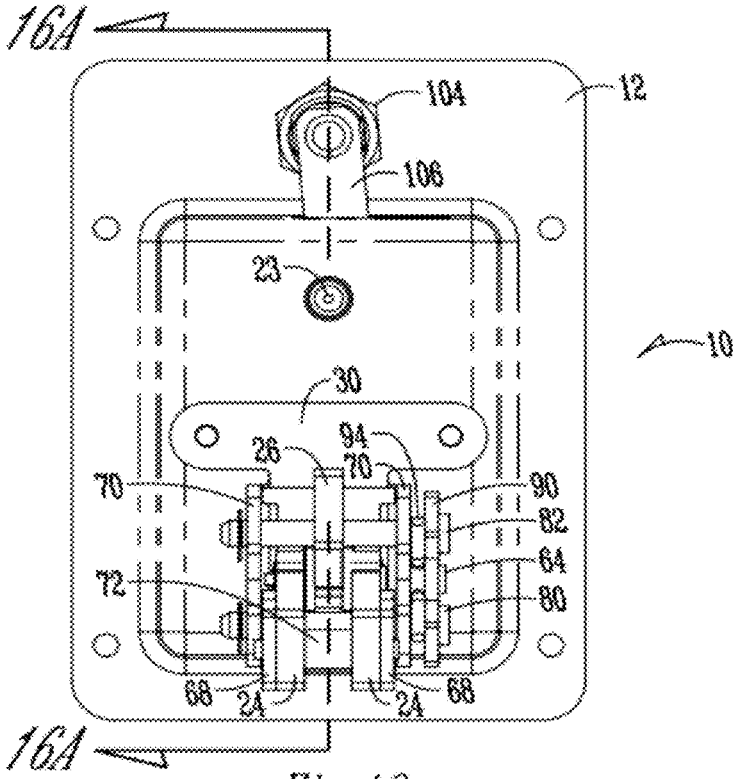
FIG. 12 is a rear plan view of the latch, with the jaws in the open position.
Figure 13:
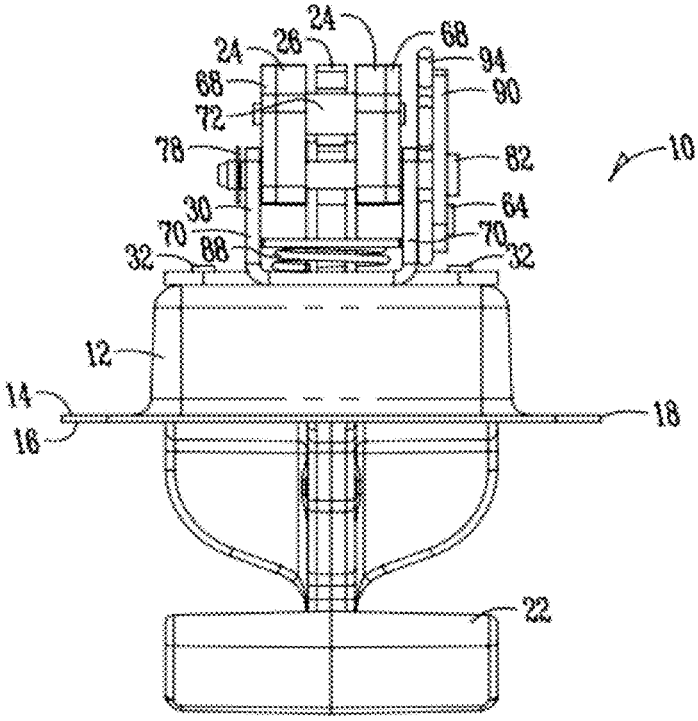
FIGS. 13 and 14 are opposite end elevation views of the latch with the handle and jaws in the open position.
Figure 14:
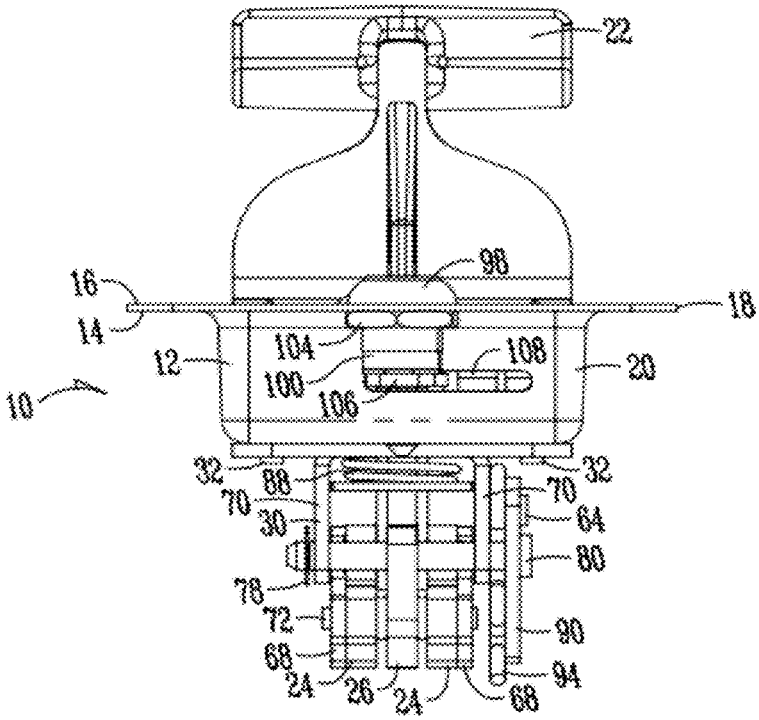
Figure 15:
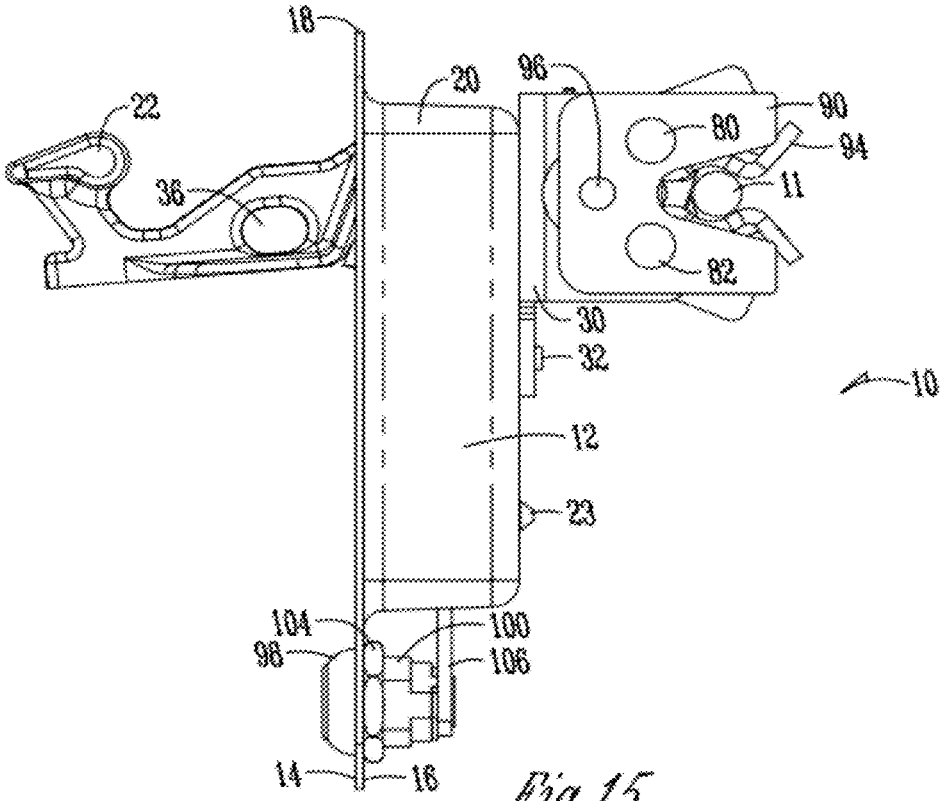
FIGS. 15 and 16 are opposite side elevation views of the latch with the handle and jaws in the open position.
Figure 16:
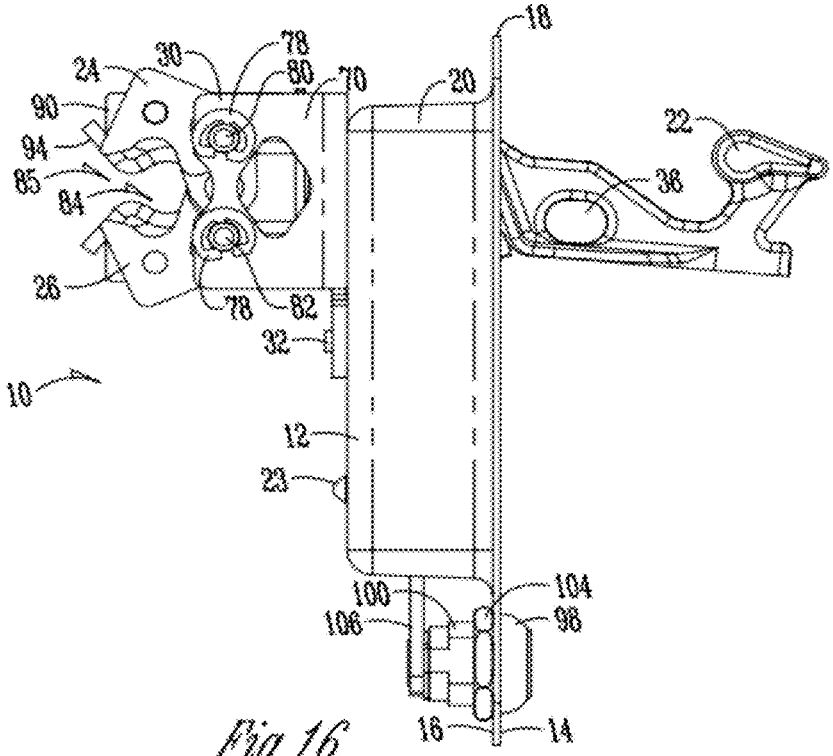
Figure 16A:
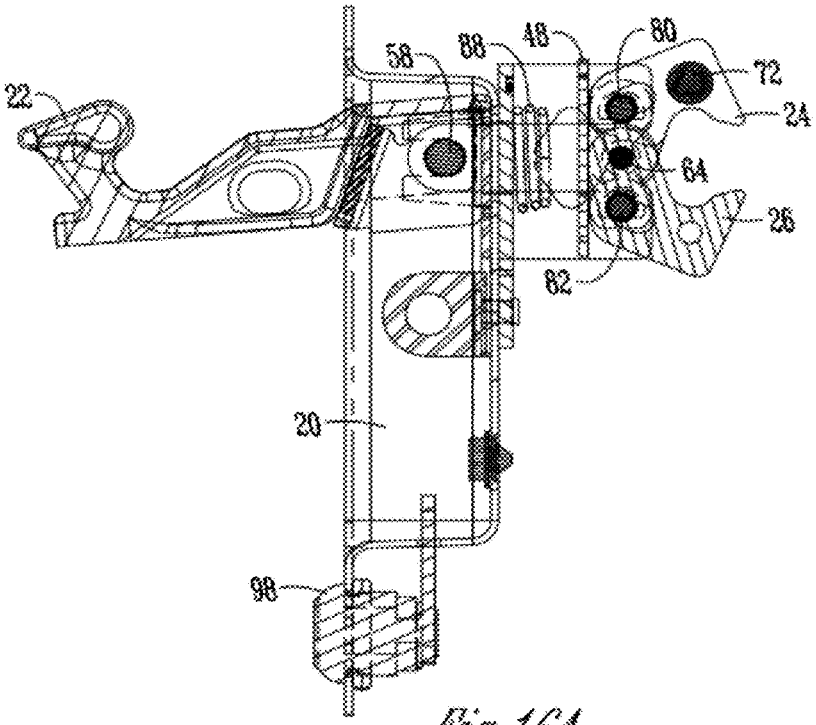
FIG. 16A is a sectional view similar to FIG. 16, taken along lines 16A-16A of FIG. 12.

Conversely, when the handle 22 is moved from the open position to the closed position, the links 38 are pulled forwardly so as to compress the spring 88 between the inside bracket 30 and the plate 48, while the lower ends of the jaws 24, 26 are pulled outwardly or forwardly by the pin 64 so as to close the jaws 24, 26 as the slots 72, 86 allow the jaws 24, 26 to pivot about the fixed guide pins 80, 82. As best seen in FIG. 10, when the jaws 24, 26 are closed, an enclosed channel 84 is formed, in which the striker pin or bolt (not shown) is captured by the jaws 24, 26. As seen in FIG. 16, when the jaws 24, 26 are open, the channel 84 has an open mouth 85 through which the striker bolt passes.

Figure 9:
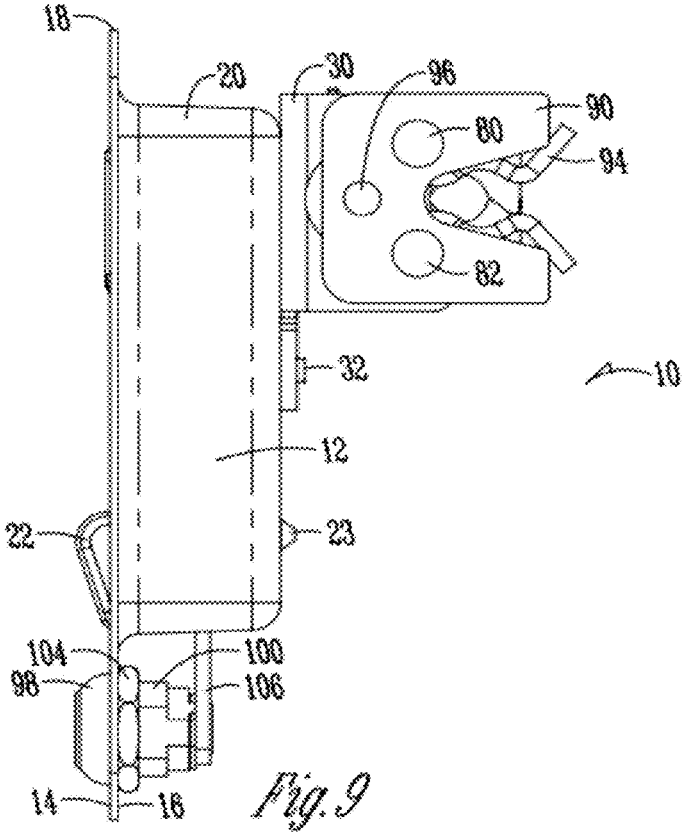
FIGS. 9 and 10 are opposite side elevation views of the latch, with the handle in the closed position.
Figure 9A:
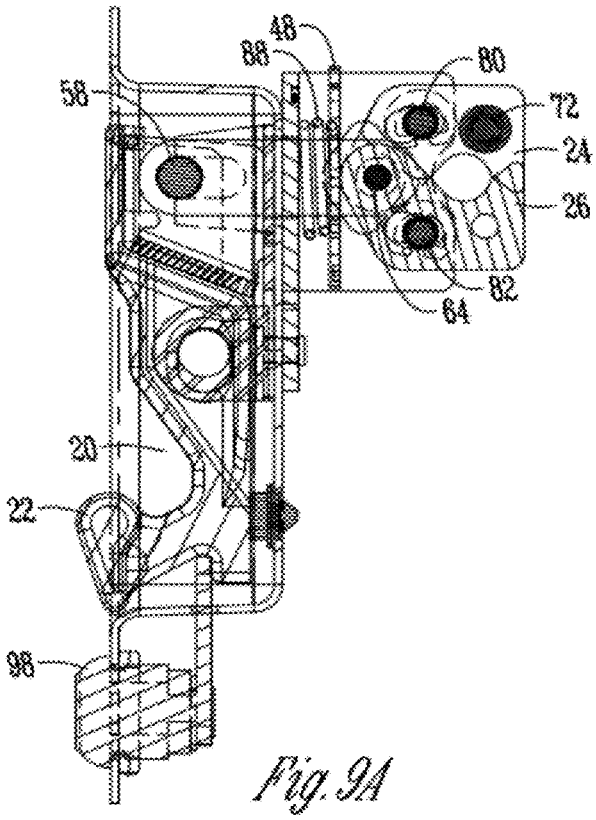
FIG. 9A is a sectional view similar to FIG. 9 and taken along lines 9A-9A of FIG. 6.
Figure 17:
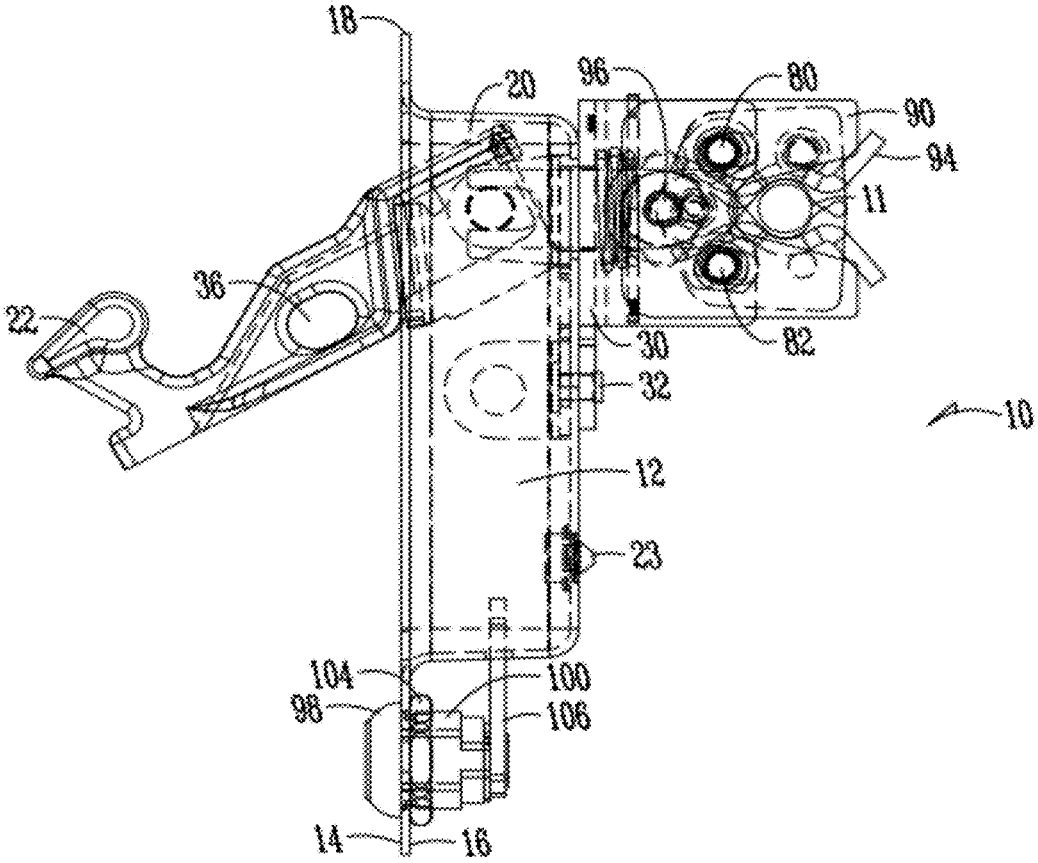
FIG. 17 is a side elevation view with the handle approximately ½ way between the closed and open positions of FIGS. 9 and 15, and showing the striker pin initially engaged by the opposing jaws.

A guide plate 90 is mounted on the ends of the pins 80, 82 adjacent one side of the inside bracket 30. The plate 90 has a V or U-shaped notch 92. A spring clip 94 is mounted to the guide plate 90 via a rivet 96. The plate 90 and notch 92 help guide the door into alignment with a striker bolt or pin 11 (FIGS. 15 and 17) on the door frame as the door is closed. The spring clip 94 also functions to temporarily retain the door in a partially closed position by capturing the striker pin, so as to minimize door bounce back, until a user moves the handle 22 from the open position to the closed position, which fully latches the jaws 24, 26 on the striker. As seen in FIGS. 9 and 10, the legs of the clip 94 and the curvature of the jaws 24, 26 define an irregular or non-round opening for the door striker. Thus, when the striker is fully captured or engaged with the jaws, the striker engages the spring clip legs to prevent rattling of the clip 94.

Thus, the slots 74, 86 function as cam followers with the jaw pins 80, 82 as the drive links 38 and drive pin 64 moves the jaws 24, 26 between the open and closed positions. The compression spring 88 provides the load in the over-center action of the jaws 24, 26, and also drives the cam profile of the jaws 24, 26 on the cam pins 80, 82 so as to push the jaws open as the handle 22 is opened. The cam slots 74, 86 act as guides to move the jaws 24, 26 open a limited amount, and also act to close and retain the jaws 24, 26 on the striker, when the handle 22 is closed. The jaws 24, 26 of the compression latch 10 capture the striker pin on opposite sides, so as to secure the door, even in the event of violent racking.

Figure 3:
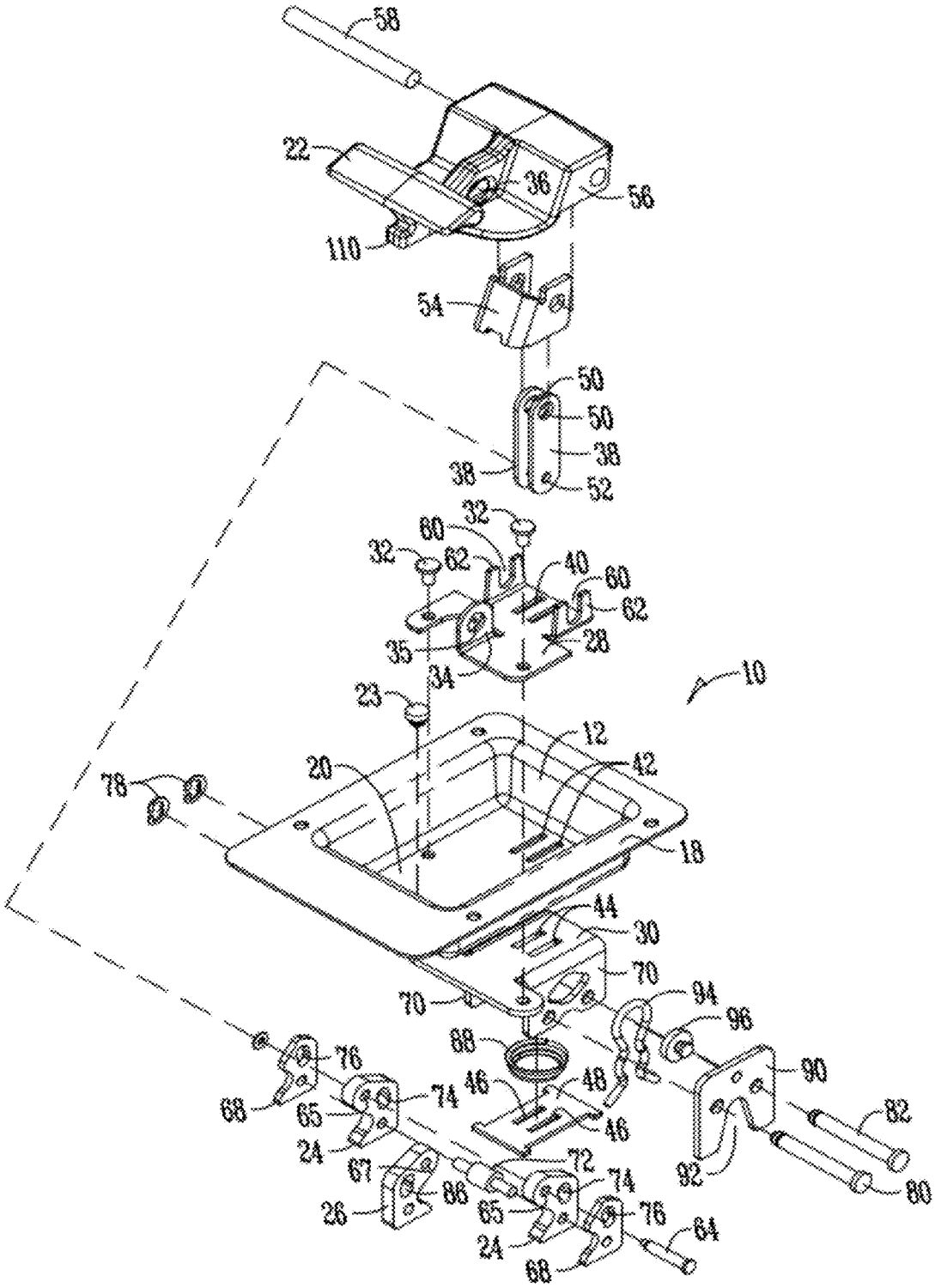
FIG. 3 is an exploded front perspective view of the latch, without a key lock mechanism.
Figure 4:
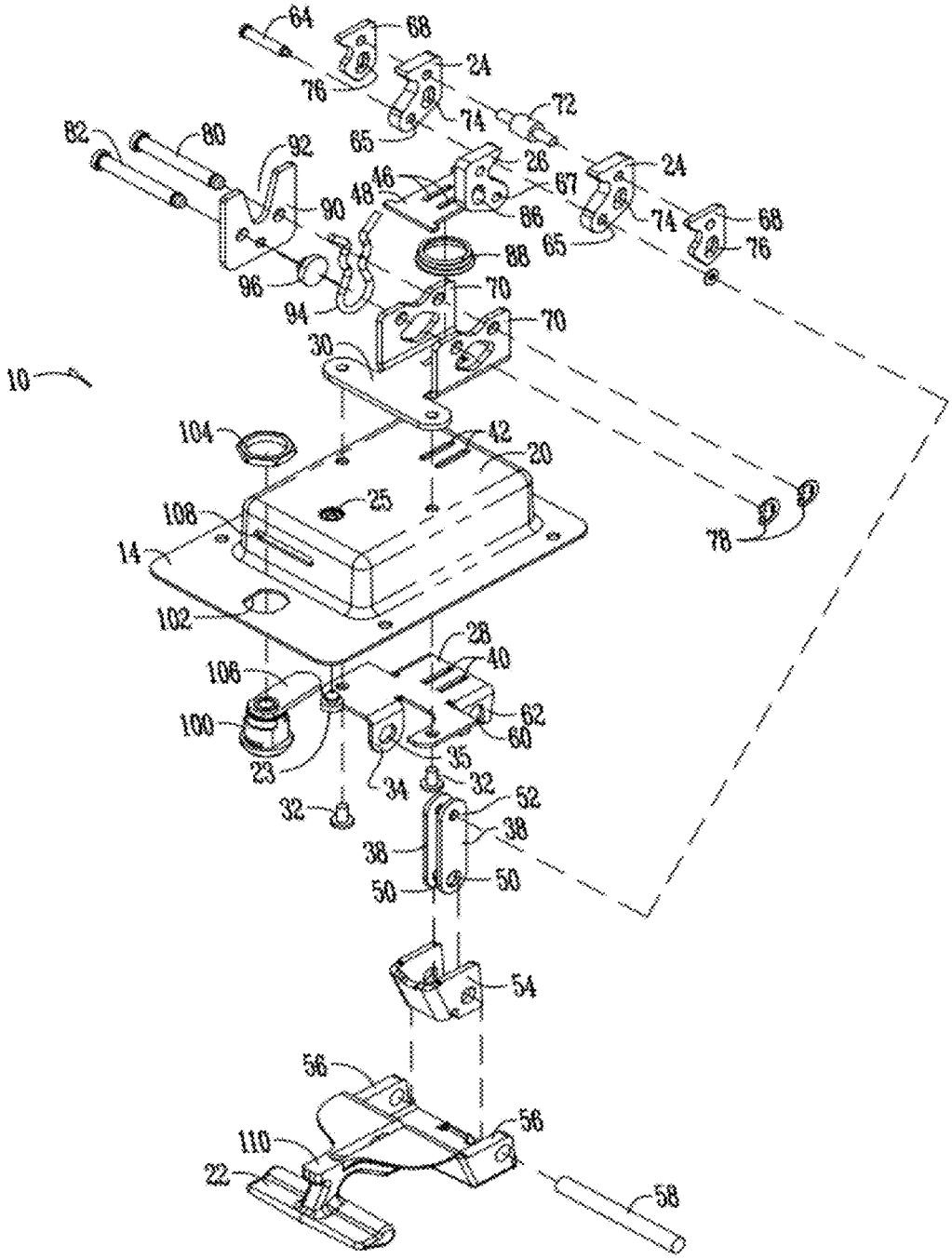
FIG. 4 is an exploded rear perspective view of the latch, with a key lock mechanism.
Figure 5:
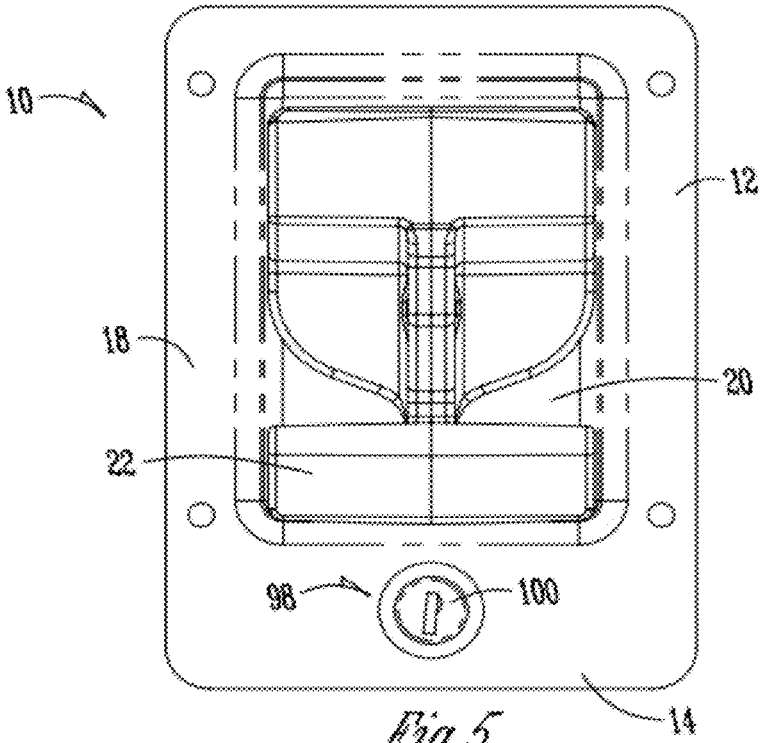
FIG. 5 is a front plan view of the latch with the handle in the closed position.
Figure 6:
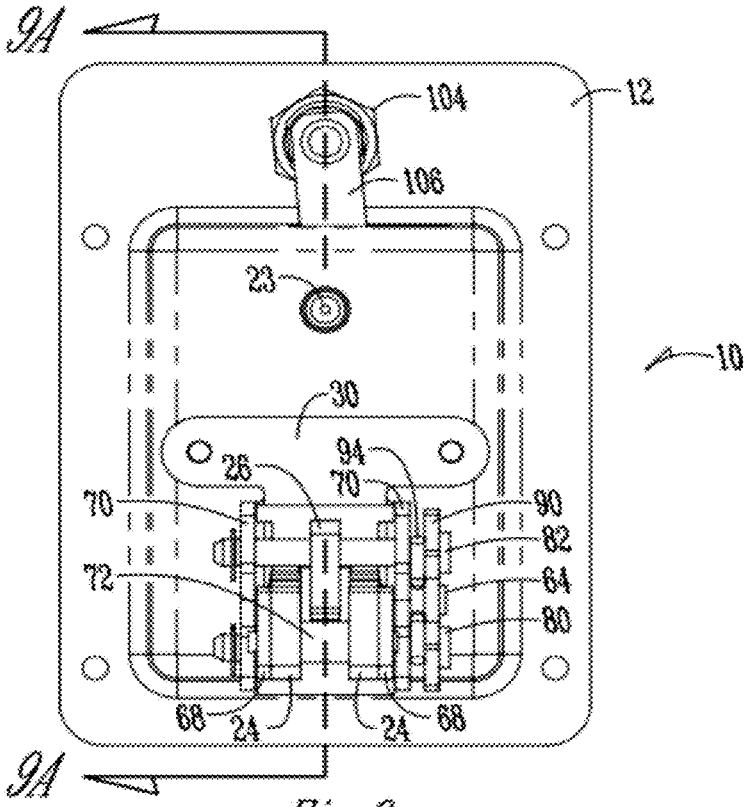
FIG. 6 is a rear plan view of the latch, with the jaws in the closed position.
Figure 7:
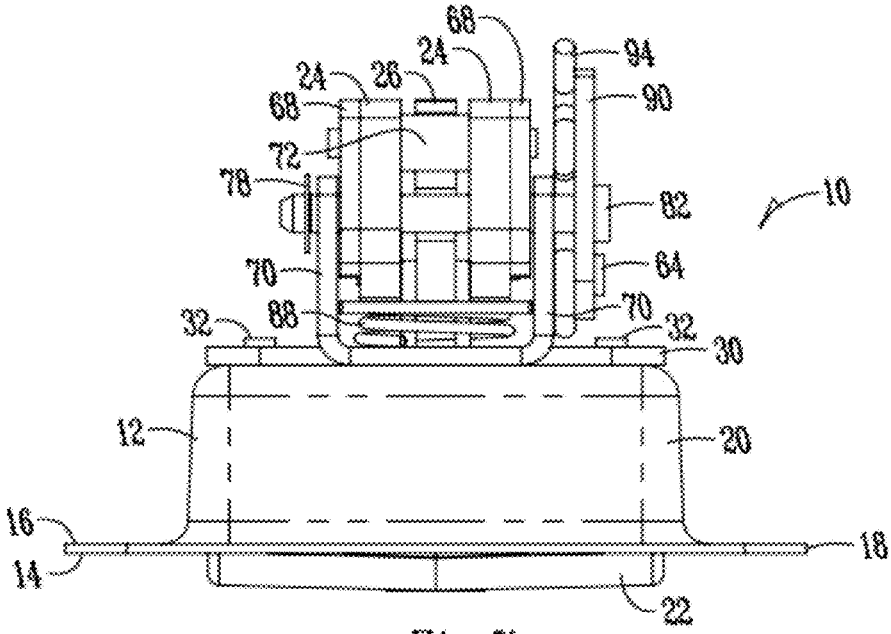
FIGS. 7 and 8 are opposite end elevation views of the latch, with the handle in the closed position.
Figure 8:
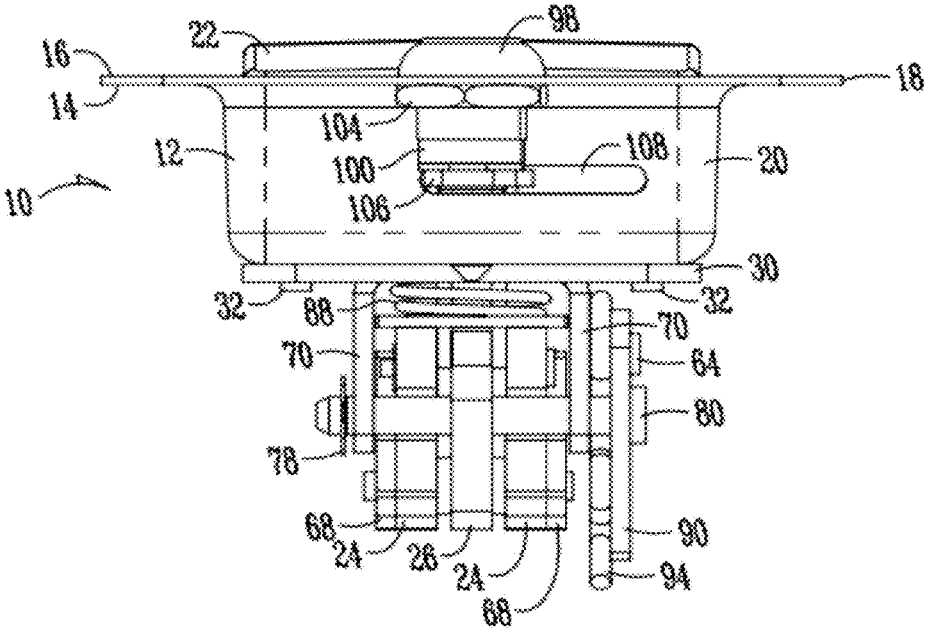

The latch 10 may include an optional key lock mechanism 98, which is shown in all of the Figures, except for the exploded view of FIG. 3. The mechanism 98 includes a key cylinder 100 mounted through a hole 102 in the flange 14 of the housing 12, and retained with a threaded lock nut 104. The lock mechanism 98 includes an actuator arm 106 extending from the key cylinder 100 and through a slot 108 in the well 20 of the housing 12. A key can be inserted into the key cylinder 100 to rotate the lock arm 106 so that the free end of the arm 106 engages and disengages a catch or lip 110 on the handle 22.

It is understood that the grapple latch 10 of the present invention can be used on any door, such as a door or access panel door or a compartment. The opposing grapple jaws 24, 26 provide a secure retention of the striker, and survive severe vibration and high loads that often accompany vehicles or equipment in off-road usage.

It is also noted that the handle 22 has a longer lever arm as compared to the jaws 24, 26, to give the user a mechanical advantage when moving the handle 22 from the open position to the closed position and pulling a high strike load into place in the jaws.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A vehicle door latch for opening and closing the door relative to a door frame, the frame having a striker pin, and the latch comprising:

a housing having front and back sides;

a handle pivotally mounted on the front side of the housing for movement between a raised open position and a lowered closed position within the housing;

opposing jaws on the back side of the housing and being connected by at least one link to the handle, the jaws being movable between an open position disengaged from the striker pin so as to allow the door to open and a closed position engaging the striker bolt to retain the door closed; and wherein movement of the handle between its open and closed positions moves the jaws between their open and closed positions, respectively.

2. The latch of claim 1 further comprising a bracket on the backside of the housing to support the jaws.

3. The latch of claim 1 wherein the at least one link is connected to and extends between the handle and the jaws to control movement of the jaws between the open and closed positions when the handle moves to the open and closed positions, respectively.

4. The latch of claim 1 wherein each jaw includes a cam slot, and a pin extending through the slot and into the mounting bracket.

5. The latch of claim 1 wherein as spring is between the handle and the jaws and provides over-center action to the handle in both the open and closed positions.

6. The latch of claim 1 further comprising a spring clip on the back side of the housing to captivate the striker pin and hold the door in a partially closed position prior to moving the handle to the closed position.

7. The latch of claim 1 further comprising a guide plate on the back side of the housing with a notch to guide the door into alignment with the striker bolt upon movement of the door from an open position to a closed position.

8. The latch of claim 1 wherein each jaw is mounted on a pivot pin and on a guide pin to control movement between the open and closed positions.

9. The vehicle door latch of claim 1 wherein movement of the jaws to the closed position pulls the door to a closed position and creates a compressive force between the door and the door frame.

10. A grapple latch for a vehicle having a door, a frame to which the door is pivotally mounted for movement between open and closed positions, and a striker on the frame, the latch comprising:

opposing jaws to retain and release the striker;

a handle connected by at least one link to the jaws to actuate opening and closing of the jaws; and a housing, with the handle and jaws being mounted on opposite sides of the housing wherein movement of the handle between a raised open position and a close position within the housing moves the jaws between open and closed positions, respectively.

11. The grapple latch of claim 10 wherein the at least one link is connected between the jaws and the handle, such that movement of the handle to an open position opens the jaws, and movement of the handle to a closed position closes the jaws.

12. The grapple latch of claim 10 wherein the jaws are coupled together for simultaneous movement relative to the striker bolt.

13. The grapple latch of claim 10 wherein each jaw includes a cam slot with a guide pin for guiding movement relative to the striker bolt.

14. The grapple latch of claim 10 further comprising a compression spring acting between the handle and the jaws to provide over-center action for the handle in both the open and closed positions.

15. The grapple latch of claim 10 further comprising a guide to align the latch with the striker bolt.

16. The grapple latch of claim 10 further comprising a clip to temporarily hold the door in a partially closed position.

17. The grapple latch of claim 10 further comprising a bracket to pivotally support the jaws.

18. The grapple latch of claim 10 being a compression latch.

* * * * *